United States Patent [19]

Hofacker, Jr.

[11] Patent Number: 4,675,932

[45] Date of Patent: Jun. 30, 1987

[54] MOP AND SCRUBBER ASSEMBLY

[76] Inventor: Rolland Hofacker, Jr., 5325 Carmilfra Dr., Sarasota, Fla. 33581

[21] Appl. No.: 893,607

[22] Filed: Aug. 6, 1986

[51] Int. Cl.[4] ..... A47L 13/12

[52] U.S. Cl. ..... 15/118; 15/229 A

[58] Field of Search ..... 15/118, 105, 228, 229 AP, 15/229 BP, 229 A

[56] References Cited

U.S. PATENT DOCUMENTS

| | | | |
|---|---|---|---|
| 3,399,499 | 9/1968 | Stetz et al. | 15/118 X |
| 3,501,796 | 3/1970 | Moss | 15/118 |
| 3,750,218 | 8/1973 | Rosocha | 15/118 |
| 3,795,934 | 3/1974 | Moss | 15/118 X |
| 4,085,476 | 4/1978 | Moss | 15/118 X |
| 4,306,326 | 12/1981 | Kim | 15/118 X |

*Primary Examiner*—Chris K. Moore

*Attorney, Agent, or Firm*—Charles J. Prescott

[57] ABSTRACT

An improved mop and scrubber assembly for use in conjunction with a mop handle, the mop handle having a bail and shoe for lockable interengagement around the transverse mid-point perimeter of the mop assembly. The mop assembly includes a plurality of strands of absorbent material, such as cotton or polyester, arrayed in side-by-side and layered fashion and held together in a bundle by transverse stitching or sewing through the strand layers adjacent each end of the bundle. Stitched or sewn onto opposite sides of the bundle about the bundle mid-portion are a layer of abrasive material and a layer of backing material. At least one end of the abrasive material, and preferably both, are looped back onto the abrasive layer itself and sewn thereto to form a transverse loop portion outwardly disposed from the bundle. In use, either the flat or looped portion of the abrasive layer, supportively backed by the bail and shoe, may be used to provide alternate dirt and stain removing enhancement characteristics of the assembly.

8 Claims, 6 Drawing Figures

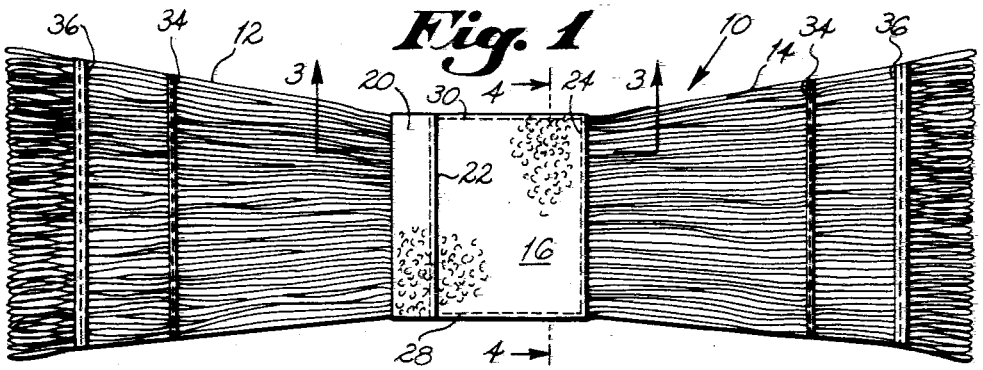
Fig. 1
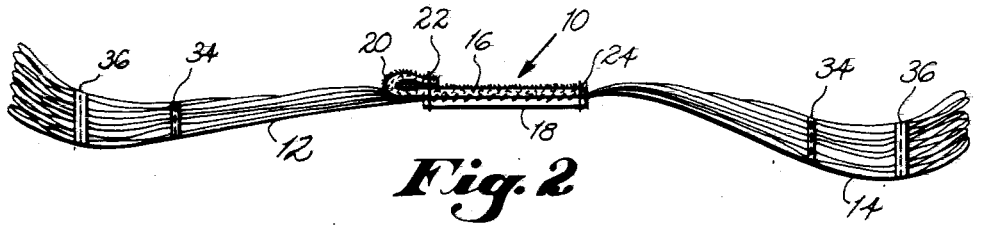
Fig. 2
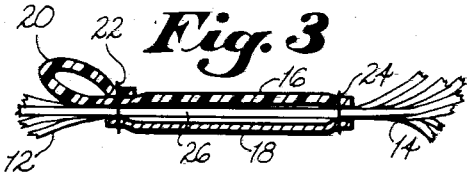
Fig. 3
Fig. 4
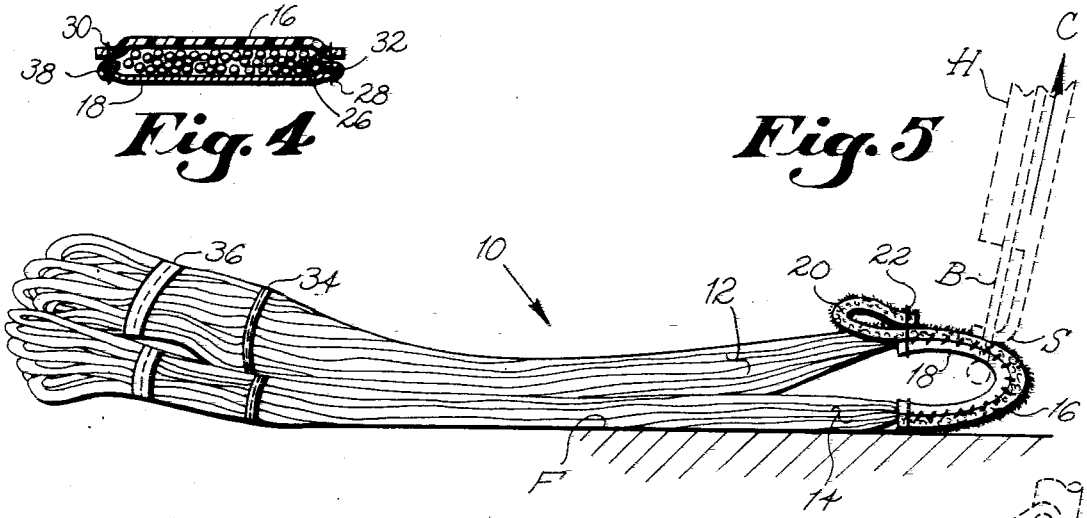
Fig. 5
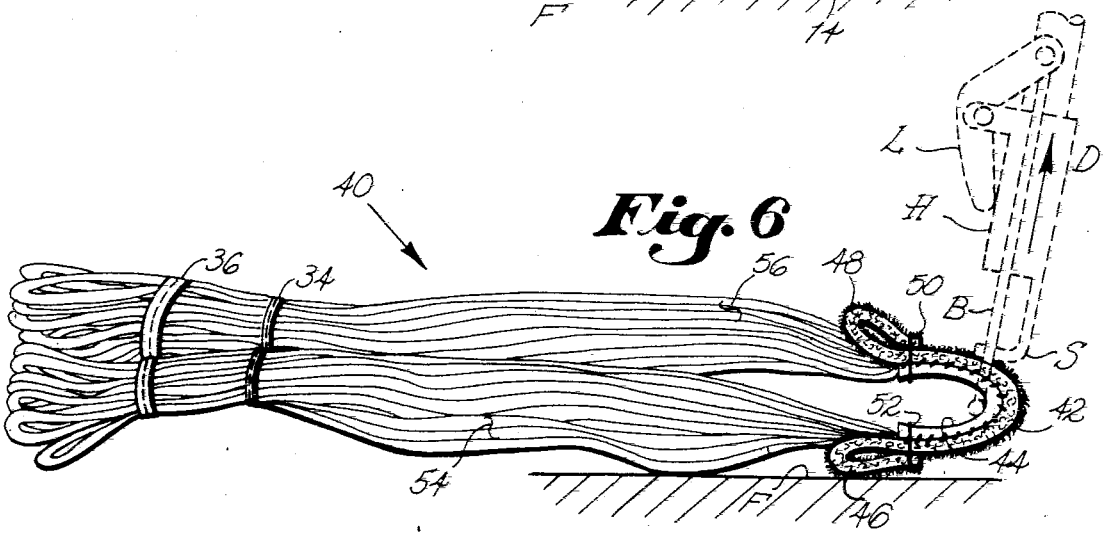
Fig. 6

MOP AND SCRUBBER ASSEMBLY

BACKGROUND OF THE INVENTION

This invention relates generally to floor cleaning devices, and more particularly to a mop assembly with improved dirt and stain removing characteristics.

Mop assemblies, comprising a plurality of elongated strands of absorbent material in side-by-side and layered arrangement held together by transverse stitching, are well known. Such mops are generally useful for light cleaning and dirt and debris pickup, as well as dispensing soap and detergent onto the floor in solution and then for removing same with clean water. However, floors which are excessively soiled or onto which heavy stains have been deposited are more difficult to remove. The user may enhance the conventional mop's dirt, soil and stain removal characteristics by bearing down on the mop handle and exerting force through the bail and shoe which interengage the mid-portion of the mop, thereby applying more pressure against the surface of the floor. This technique, however, is limited by the softness of the absorbent strands of the mop assembly.

Applicant is only aware of one soil and dirt enhancing addition to these conventional mop assemblies. This is in the form of an abrasive pad which is generally rectangular in shape and sewn or stitched transversely to one side of the mop assembly along one edge margin of the abrasive pad at a mid point of the mop assembly. The other end and side margins of this abrasive pad are free, thereby allowing the abrasive pad to act as a flap. However, because the pad itself is limited in thickness, when force is applied to the pad for stain and soil removal via the mop handle, the underlying mop strands, being wet and absorbent, give way and limit the amount of surface pressure which may be applied against the floor for stain removal. Additionally, because the absorbent material is single-layered, it is significantly limited in its ability to conform to irregularities and tile seams or the like in floors. Moreover, the flap-like abrasive pad member is a cumbersome annoyance to deal with in rinsing and squeeze drying the mop in conventional buckets in that its "flappiness" causes the flap to be difficult to contain and manage, and may, and usually does, lead to tearing of the flap.

The present invention provides an improved mop and scrubber assembly which provides enhanced scrubbing and stain removal characteristics while also maintaining compactness and strength of the attachment of the abrasive pad to the mop assembly. Additionally, the structure provided by the present invention affords the user the ability to apply increased pressure against the floor for removal of difficult stains, while also maintaining a high degree of compressiveness and, thus adaptability to variations and irregularities in floor contour.

BRIEF DESCRIPTION OF THE INVENTION

This invention is directed to an improved mop and scrubber assembly for use in conjunction with a mop handle, the mop handle having a bail and shoe for lockable interengagement around the transverse mid-point perimeter of the mop assembly. The mop assembly includes a plurality of strands of absorbent material, such as cotton or polyester, arrayed in side-by-side and layered fashion and held together in a bundle by transverse stitching or sewing through the strand layers adjacent each end of the bundle. Stitched or sewn onto opposite sides of the bundle about the bundle mid-portion are a layer of abrasive material and a layer of backing material. At least one end of the abrasive material, and preferrably both, are looped back onto the abrasive layer itself and sewn thereto to form a transverse loop portion outwardly disposed from the bundle. In use, either the flat or looped portion of the abrasive layer, supportively backed by the bail and shoe, may be used to provide alternate dirt and stain removing enhancement characteristics of the assembly.

It is therefore an object of this invention to provide an improved mop and scrubber assembly which provides substantially increased stain and dirt removal characteristics.

It is another object of this invention to provide an improved mop and scrubber assembly which readily adapts and conforms to floor surface irregularities and contours.

It is another object of this invention to provide an improved mop and scrubber assembly which may be manipulated into conventional buckets and squeezers without undue interference therewith.

It is another object of this invention to provide an improved mop and scrubber assembly which includes opposing backing material for added strength and to provide such structure which resists tearing and damage during operation.

In accordance with these and other objects which will become apparent hereinafter, the instant invention will not be described with reference to the accompanying drawings in which:

BRIEF DESCRIPTION OF THE DRAWINGS

FIG. 1 is a top plan view of the invention.

FIG. 2 is a side elevation view of the invention.

FIG. 3 is a section view in the direction of arrows 3—3 in FIG. 1.

FIG. 4 is a section view in the direction of arrows 4—4 in FIG. 1.

FIG. 5 is a side elevation view of the invention in use in conjunction with a mop handle.

FIG. 6 is another embodiment of the invention in use in conjunction with a mop handle.

DETAILED DESCRIPTION OF THE INVENTION

Referring now to the drawings, and particularly to FIGS. 1 and 2, the invention is shown generally at 10 and includes a plurality of strands of absorbent material, preferrably cotton or polyester, longitudinally extending from the mid portion of the mop and forming mop assembly halves 12 and 14. These strands of material are held together in a bundle by transverse stitching and binding or backing material at 34 and 36, although this transverse stitching along 34 and 36 is only included in higher quality mop assemblies 10.

Sewn or stitched on either side surface of the mop assembly 10, evenly spaced about the mid-portion thereof, are a layer of abrasive material 16 and a layer of backing material 18. The structure in the mid-portion of the mop 10 is best seen in FIGS. 3 and 4. The bundle of absorbent strands 26 is surrounded or encapsulated by the abrasive layer 16 and backing layer 18 by stitching along edge margins 28 and 30, as well as transverse stitching along end margins 22 and 24. Although the transverse stitching along 34 and 36 is preferred, the transverse stitching at 22 and 24 which passes through the abrasive layer 16, the bundle of absorbent strands 26, and the backing material 18 is generally sufficient to bind all of these elements into the mop assembly 10 for use as described. The backing material is also hemmed at 28 and 38 along the edge margins for increased strength.

The layer of abrasive material 16 extends beyond the transverse stitching at 22 to form a loop 20 which doubles back onto the abrasive material 16 itself to be bound by transverse stitching 22. As clearly shown, this loop 20 extends outwardly from the mop half 12 to function as herebelow described.

Referring additionally to FIG. 5, the mop assembly 10 is shown assembled to a conventional mop handle H which includes a bail B and shoe S. The bail B, passing transversely across the backing material 18, is lockable in the direction of arrow C to secure the entire layered mid-portion of the mop 10 as shown for use. By having the mop assembly 10 in the position shown, loop 20 is upwardly disposed, while the flat portion of the abrasive layer 16 is against the floor F for cleaning. In this mode of use, vigorous scrubbing action on flat, uncontoured portions of the floor is available by the downward pressure against handle H in conjunction with normal back and forth movement of the mop assembly 10.

Referring now to FIG. 6, the alternate and preferred embodiment of the invention is shown generally at 40 having an abrasive layer 42 and a backing layer 44 disposed and secured on either side of the bundle of strands which form mop assembly halves 54 and 56 as previously described. Again, stitching and backing material at 34 and 36 transversely adjacent the ends of the strands serve to additionally secure these strands into a bundle. In this preferred embodiment, loops 46 and 48 of the abrasive material 42 are formed extending beyond transverse stitching 50 and 52. Again, handle H is shown lockably engaged around the layered mid-section of the mop assembly 40 by bail B against shoe S, bail B lockable in the direction of arrow D by lever L. In this arrangement, the user need not be concerned as to which side of the mop assembly 40 is against the floor F. Either loop 48 or 46 is always downwardly extending toward the floor F for use in scrubbing.

By the downward exertion of force on handle H, in conjunction with back and forth movement of the mop assembly 40 against floor F, loop 46, which happens to be the one downwardly disposed, provides abrasive material against the floor for scrubbing and, additionally, by the compressability of loop 46, also provides enhance ability of the abrasive surface to enter cracks and adapt to variations and contour of various floor coverings available, including tile.

Because the loops 20, 46 and 48, as shown in the two embodiments in FIG. 1-6, are secured back onto the abrasive layer itself as shown, these loops 22, 46 and 48 pose no substantial outwardly extending protrusions to cause interference with the normal rinsing and squeezing of these mop assemblies 10 and 40 in buckets. Therefore, the possibility of tearing the abrasive material from the mop assemblies 10 and 40, either during rinsing and squeezing in a conventional bucket or during use as the mop halves 12 and 14, 54 and 56, pass beneath or around furniture or obstructions placed on or slightly above the floor F.

The preferred embodiment of the abrasive material is a non-woven, nylon fiber held together by an adhesive or resin material. Additionally, the abrasive material may include a mineral filler for enhanced abrasive cleaning, such as silicon carbide, aluminum oxide, talc, garnet, flint, or the like. This abrasive material is available through Minnesota Mining and Manufacturing Co. under the trade name SCOTCH BRITE, as well as from other sources of such materials.

While the instant invention is shown and described herein in what is conceived to be the most practical and preferred embodiment, it is recognized that departures may be made therefrom within the scope of this invention, which is therefore not to be limited to the details disclosed herein, but is to be accorded the full scope of the claims so as to embrace any and all equivalent apparatus and articles.

What is claimed is:

1. A mop and scrubber assembly for use in conjunction with a mop handle having a bail and shoe for lockable interengagement around the transverse perimeter at the mid-point of said mop assembly, said mop assembly comprising:

a plurality of absorbent strands arranged in side-by-side and layered fashion in a bundle;

a layer of abrasive material and an opposing layer of backing material both stitched together along respective end and edge margins and having said mid-portion of said strands stitched therebetween;

said abrasive layer end margins transversely disposed, one said end margin extending beyond said transverse stitching and looped back to said transverse stitching against said abrasive layer forming a transverse loop at one end of said abrasive layer outwardly disposed from said bundle.

2. A mop and scrubber assembly as set forth in claim 1, wherein:

said absorbent strands include transverse stitching adjacent the ends of said bundle to secure said strand ends together.

3. A mop and scrubber assembly as set forth in claim 1, wherein:

said abrasive material is non-woven nylon fiber held together by an adhesive system.

4. A mop and scrubber assembly as set forth in claim 3, wherein:

said abrasive material is SCOTCH BRITE.

5. A mop and scrubber assembly for use in conjunction with a mop handle having a ball and shoe for locakable interengagement around the transverse mid-point of said mop assembly, said mop assembly comprising:

a plurality of absorbent strands arranged in side-by-side and layered fashion in a bundle;

a layer of abrasive material and an opposing layer of backing material both stitched together along respective end and edge margins and having the mid-portion of said strands stitched therebetween;

said abrasive layer end margin transversely disposed and extending in both directions beyond said end margin stitching and looped back to said transverse stitching against said abrasive layer forming a transverse loop at each end of said abrasive layer;

said loops outwardly disposed from said bundle.

6. A mop and scrubber assembly as set forth in claim 5, wherein:

said absorbent strands include transverse stitching adjacent the ends of said bundle to secure said strand ends together.

7. A mop and scrubber assembly as set forth in claim 5, wherein:

said abrasive material is non-woven nylon fiber held together by an adhesive system.

8. A mop and scrubber assembly as set forth in claim 7, wherein:

said abrasive material is SCOTCH BRITE.

* * * * *